US009745983B2

(12) United States Patent
Pihet

(10) Patent No.: US 9,745,983 B2
(45) Date of Patent: Aug. 29, 2017

(54) VENTILATION DEVICE PROVIDED WITH A VOLUTE-SHAPED CASING

(71) Applicant: MAHLE International GmbH, Stuttgart (DE)

(72) Inventor: David Pihet, Beuvillers (FR)

(73) Assignee: MAHLE International GmbH, Stuttgart (DE)

( * ) Notice: Subject to any disclaimer, the term of this patent is extended or adjusted under 35 U.S.C. 154(b) by 438 days.

(21) Appl. No.: 14/414,236

(22) PCT Filed: Jun. 17, 2013

(86) PCT No.: PCT/EP2013/062475

§ 371 (c)(1),
(2) Date: Jan. 12, 2015

(87) PCT Pub. No.: WO2014/009103

PCT Pub. Date: Jan. 16, 2014

(65) Prior Publication Data

US 2015/0204337 A1 Jul. 23, 2015

(30) Foreign Application Priority Data

Jul. 13, 2012 (FR) ..... 12 56755

(51) Int. Cl.
*F04D 17/10* (2006.01)
*F04D 29/42* (2006.01)
(Continued)

(52) U.S. Cl.
CPC ..... *F04D 17/10* (2013.01); *F04D 17/16* (2013.01); *F04D 29/4226* (2013.01); *F04D 29/4233* (2013.01); *F04D 29/663* (2013.01)

(58) Field of Classification Search
CPC ..... F04D 17/10; F04D 17/16; F04D 29/4213; F04D 29/422; F04D 29/4233; F04D 29/4226; F04D 29/28; F04D 29/6631
(Continued)

(56) References Cited

U.S. PATENT DOCUMENTS 2,452,274 A 10/1948 Walters
5,741,118 A * 4/1998 Shinbara ..... F04D 29/283 416/185
(Continued)

OTHER PUBLICATIONS

DP-320414 PCT/EP2013/062475 Written Opinion of the International Search Authority.

*Primary Examiner* — Kenneth Bomberg
*Assistant Examiner* — Jesse Prager
(74) *Attorney, Agent, or Firm* — Brinks Gilson & Lione

(57) ABSTRACT

Ventilation device including a turbine mounted inside a radially volute-shaped casing, the peripheral wall of the casing moving progressively away from the periphery of the turbine from a volute tongue to a distal end ($E_2$) of the volute, the radial expansion of the volute being defined by an angle of expansion ($a_i$), characterised by the fact that the initial angle of expansion ($a_1$) in the vicinity of the volute tongue is 1.5 times to 3 times greater than the final angle of expansion ($a_2$) in the vicinity of the distal end ($E_2$) of the volute, so that the peripheral wall of the casing moves away from the blades more rapidly at the start of the volute minimising the turbulences generated at the volute tongue.

11 Claims, 3 Drawing Sheets

(51) Int. Cl.
*F04D 17/16* (2006.01)
*F04D 29/66* (2006.01)

(58) Field of Classification Search
USPC ..... 415/204, 206
See application file for complete search history.

(56) References Cited

U.S. PATENT DOCUMENTS

| | | | | |
|---|---|---|---|---|
| 7,334,986 | B2 * | 2/2008 | Sohn | F04D 29/422 415/204 |
| 9,039,363 | B2 * | 5/2015 | Hancock | F04D 29/4226 415/206 |
| 2002/0131861 | A1 * | 9/2002 | Sakai | F04D 29/422 415/204 |

* cited by examiner

VENTILATION DEVICE PROVIDED WITH A VOLUTE-SHAPED CASING

CROSS-REFERENCE TO RELATED APPLICATION

This application claims the benefit of PCT Application Serial No. PCT/EP2013/062475 for a VENTILATION DEVICE PROVIDED WITH A VOLUTE-SHAPED CASING filed on 17 Jun. 2013, which claims priority to French Application Serial No. FR1256755 filed on 13 Jul. 2010. Both above PCT Application No. PCT/EP2013/062475 and French Application No. FR1256755 are hereby incorporated by reference in their entirety.

TECHNICAL FIELD

The present invention relates to a ventilation device for an apparatus for heating, ventilation and/or air-conditioning, or HVAC (Heating Ventilating Air Conditioning), particularly intended to be fitted to a motor vehicle.

TECHNOLOGICAL BACKGROUND OF THE INVENTION

The invention relates more particularly to a ventilation device comprising at least one organ for centrifugal propulsion of air intended to route the air through a distribution circuit towards the passenger space of the vehicle. The centrifugal propulsion organ includes an annular turbine provided with blades which is driven in rotation about an axis of rotation by a motor and which is generally arranged at the centre of a volute-shaped casing. The air is taken by the turbine axially from outside the casing and is driven along a passage formed by the casing to an evacuation orifice, or radial air delivery mouth communicating with the distribution circuit.

The passage is delimited by the outer surface of revolution of the turbine, defined by the outer section of the blades, and the inner face of the peripheral wall of the casing shrouding the turbine blades at a distance. The radial profile of the peripheral wall of the casing evolves in a volute so as to cause progressive variation of the separation distance between the section of the blades and the inner face of the peripheral wall. The peripheral wall therefore forms a spiral around the turbine in the direction, the said spiral evolving in the direction of rotation of the turbine.

To define the shape of the volute, an angle of expansion of the volute is defined which corresponds, at a determined point of the volute, to the angle formed between the tangent to the volute and the tangent to a circle passing through this point, the centre of the volute and of the said circle here being formed by the axis of rotation of the turbine.

Generally, travelling through the volute in the direction of rotation of the turbine, it is found that the angle of expansion is substantially uniform, which leads to a regular increase in the distance between the outer section of the blades of the turbine and the inner face of the peripheral wall.

For the design of such a ventilation device, it is necessary to deal with different parameters such as the efficiency of the device, the yield and flow-rate of air provided by the turbine, the overall size and the relative dimensions between the turbine and the casing, as well as the noise pollution generated. It is generally desirable to have the smallest possible size of the device to optimise the available space, and it is desirable to avoid as much as possible the creation of zones of turbulences generating noise pollution.

Various solutions and different compromises have been proposed in the devices of the prior art, but they do not allow an entirely satisfactory result to be obtained in terms of size and of sound level.

SUMMARY OF THE INVENTION

The invention is intended to resolve the problem mentioned above by proposing a ventilation device which is particularly efficient, notable in terms of size and of sound level.

To this end, the invention proposes a ventilation device for an apparatus for heating, ventilation and/or air-conditioning of a passenger space of a motor vehicle, including a turbine with blades mounted turning about an axis of rotation inside a radially volute-shaped casing, the casing including an axial mouth for aspiration of air and a radial mouth for delivery of air which communicate with the inside of a volute-shaped compartment delimited by the peripheral wall of the casing, the peripheral wall of the casing moving progressively away from the periphery of the turbine from a volute tongue to a distal end of the volute, the radial expansion of the volute being defined by an angle of expansion, characterised by the fact that the initial angle of expansion in the vicinity of the volute tongue is 1.5 times to 3 times greater than the final angle of expansion in the vicinity of the distal end of the volute, so that the peripheral wall of the casing moves more rapidly away from the blades at the start of the volute minimising turbulences generated at the volute tongue.

The trials carried out by the applicant have permitted demonstration that the combination of characteristics of the ventilation device in accordance with the invention allows particularly good results to be obtained, in particular regarding sound level since it was possible to save several decibels (at least 3 dB(A)) by reducing undesirable turbulences while maintaining a high flow rate of forced air and forced air flow velocity. Moreover, these good results were obtained with a constant external size of the casing, i.e. without having to increase the external dimensions of the casing.

The ventilation device in accordance with the invention also has the advantage of obtaining these good results while having a structure which is easy to manufacture and to assemble, so that the cost of manufacture/efficiency ratio is particularly advantageous.

Advantageously, particularly good results are obtained when the radial expansion of the volute is defined by the equation:

$$R_{vi} = (R_t + d_{tv}) \times e^{\left(\theta_i \times \tan\left(a_1 - \left(\frac{a_1 - a_2}{\theta_{max}}\right) \times \theta_i\right)\right)}$$

in which:

- $R_{vi}$ is the radius of the volute at a determined point of the volute,
- $R_t$ is the outer radius of the turbine,
- $d_{tv}$ is the minimum radial distance between the outer edge of the blades of the turbine and the volute tongue,
- $\theta_i$ is the angle defined by the initial end of the volute and the determined point of the volute about the axis of rotation,
- $a_1$ is the initial angle of expansion of the volute,
- $a_2$ is the final angle of expansion of the volute,
- $\theta_{max}$ is the volute angle which corresponds to the angle defined by the initial end of the volute and the distal end of the volute about the axis of rotation.

In accordance with other advantageous characteristics of the invention:

- the volute angle is between 290 and 315 degrees;
- the initial angle of expansion is between 3.5 and 9 degrees;
- the final angle of expansion is between 3 and 5 degrees;
- the axial section of the peripheral wall of the volute has a generally "C"-shaped profile, preferably an ovalised profile;
- the radial delivery mouth has an axial section of rounded or ovalised profile so that the outlet section, which extends from the distal end of the volute to the radial delivery mouth, progressively forms a tube;
- the evolution of the axial expansion of the volute generally follows the evolution of its radial expansion;
- the volute tongue generally has an ovalised profile;
- the outer profile of the turbine, in an axial plane, is generally parallel with the axis of the turbine;
- the inner circumferential edge of the volute is extended, on the side of the axial aspiration mouth, by a radial extension which covers a portion of the turbine and which delimits the axial aspiration mouth;
- the casing is made in the form of two half-shells, preferably formed by moulding in a plastics material, the two half-shells being assembled one with the other in a joint plane perpendicular to the axis of the turbine.

BRIEF DESCRIPTION OF THE DRAWINGS

Other characteristics, aims and advantages of the invention will become apparent on reading the following detailed description, and with reference to the attached drawings, given by way of non-limiting example and in which.

DESCRIPTION OF THE INVENTION

FIGS. 1 to 5 show a ventilation device 10 formed in accordance with the teachings of the invention and intended to be fitted to a heating, ventilation and/or air-conditioning apparatus of a motor vehicle passenger space.

The ventilation device 10 includes a turbine 12 with blades 13 mounted turning about an axis of rotation A1 inside a radially volute-shaped casing 14.

In the remainder of the description, in non-limiting manner, will be used a vertical axial orientation along the axis of rotation A1 and a radial orientation relative to the axis of rotation A1.

Figure 3:
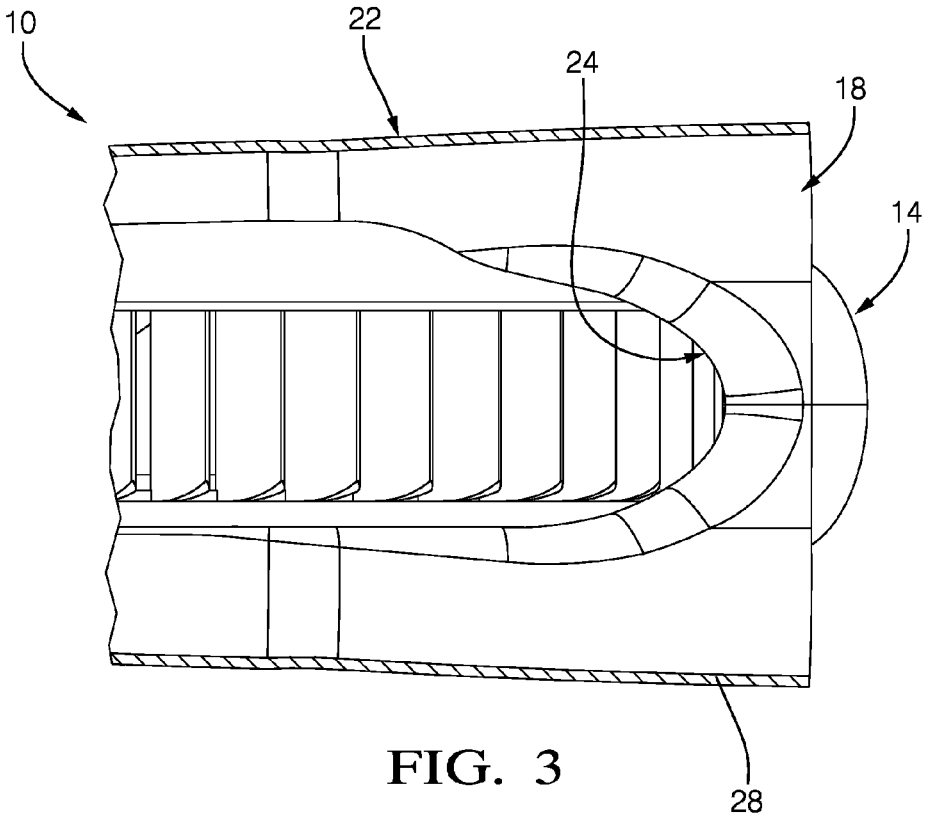
FIG. 3 is a view in partial axial section which shows the volute tongue of the casing of FIG. 1.
Figure 4:
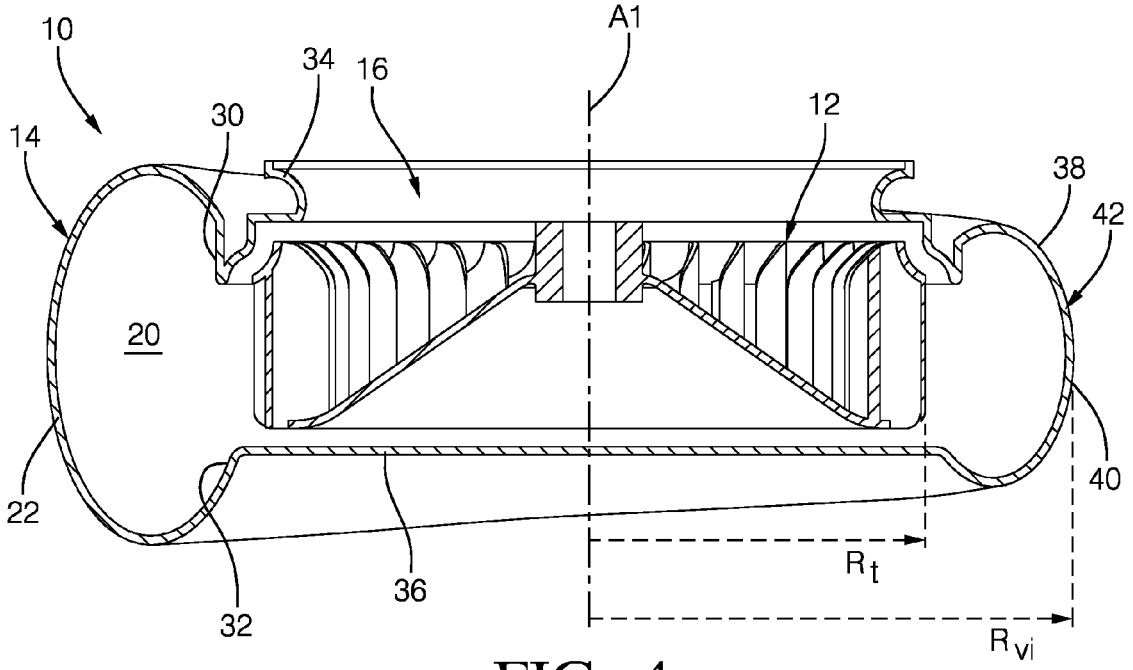
FIG. 4 is a view in axial section along the plane 4-4 which shows the ventilation device of the figure and which illustrates the profile of the peripheral wall of the casing.
Figure 5:
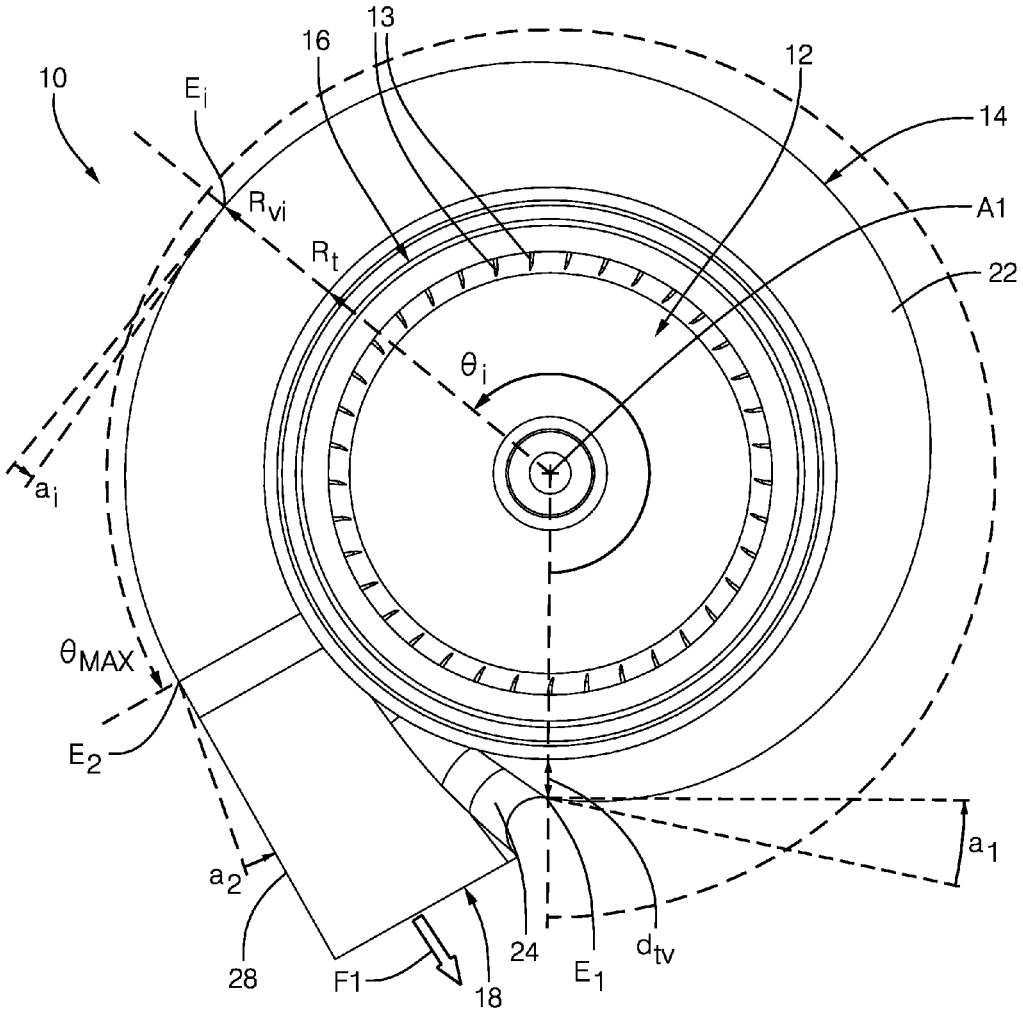
FIG. 5 is a view from above which shows the ventilation device of FIG. 1 and which illustrates the angles of expansion of the volute.

The casing 14 includes an axial mouth 16 for aspiration of air and a radial mouth 18 for delivery of air which communicate with the inside of a compartment 20, or passage, in the form of a volute delimited by the peripheral wall 22 of the casing 14. In a radial plane, the peripheral wall 22 of the casing 14 moves radially and progressively away from the periphery of the turbine 12 from a volute tongue 24 to a distal end $E_2$ of the volute, as shown in FIG. 5. The volute tongue 24, which is shown in more detail in FIG. 3, is formed by a portion of the peripheral wall 22 which is generally situated at the intersection between the volute and a tubular outlet section 28, which extends from the distal end $E_2$ of the volute to the radial mouth 18. The distal end $E_2$ of the volute generally corresponds to the end of the radial expansion of the casing 14, the outlet section 28 extending in generally rectilinear manner in the direction of the delivery of air F1, in a generally tangential direction relative to the turbine 12.

FIG. 5 shows the initial angle of expansion $a_1$ of the volute at its origin i.e. at the initial end $E_1$ situated at the volute tongue 24.

At its tongue 24, the volute includes an initial angle of expansion $a_1$ and at its distal end $E_2$ a final angle of expansion $a_2$. The value of the initial angle of expansion $a_1$ is preferably between 1.5 and 3 times the value of the final angle of expansion $a_2$.

The higher value of the initial angle of expansion $a_1$ allows the volute to move radially away from the turbine 12 more rapidly at the beginning of its radial expansion than at the end of its radial expansion so as to minimise the turbulences produced in the flow of air at the volute tongue 24 which are the source of considerable sound pollution taking into account the close proximity of the volute tongue 24 with the turbine 12.

Preferably, the angle of expansion $a_1$ increases progressively until it reaches its median value in the region of the first third of the volute.

Advantageously, the radial expansion of the volute is defined by the equation:

$$R_{vi} = (R_t + d_{tv}) \times e^{\left(\theta_i \times \tan\left(a_1 - \left(\frac{a_1 - a_2}{\theta_{max}}\right) \times \theta_i\right)\right)} \quad (1)$$

in which:

- $R_{vi}$ is the radius of the volute at a determined point $E_i$ of the volute,
- $R_t$ is the outer radius of the turbine 12,
- $d_{tv}$ is the minimum radial distance between the outer edge of the blades 13 of the turbine 12 and the volute tongue 24,
- $\theta_1$ is the angle defined by the initial end $E_1$ of the volute and the determined point $E_1$ of the volute about the axis of rotation A1,
- $a_1$ is the initial angle of expansion of the volute,
- $a_2$ is the final angle of expansion of the volute,
- $\theta_{max}$ is the volute angle which corresponds to the angle defined by the initial end $E_1$ of the volute and the distal end $E_2$ of the volute about the axis of rotation A1.

The volute angle $\theta_{max}$ thus defines the value of the angular sector along which the volute develops.

The initial angle of expansion $a_1$ of the volute is preferably between 3.5 and 9 degrees and the final angle of expansion $a_2$ is preferably between 3 and 5 degrees.

The volute angle $\theta_{max}$ is preferably between 290 and 315 degrees.

The equation (1) allows definition of the evolution of the radius $R_{vi}$ of the volute from the initial end $E_1$ to the distal end $E_2$. This equation has been formulated so as to allow both a greater initial angle of expansion $a_1$ than the final angle of expansion $a_2$ and controlled progressivity of the radial expansion. The tests and measurements are performed by the applicant have shown excellent results in terms of reduced sound level and in terms of the efficiency of the forced air flow. The equation (1) allows a spiral profile to be obtained for the volute which is particularly well suited to applications of the HVAC type for motor vehicles.

Preferably, the evolution of the axial expansion of the volute, i.e. the evolution of the maximum axial dimension of the peripheral wall 22, generally follows the evolution of the radial expansion of the volute. In accordance with a modified embodiment, the evolution of the axial expansion can be disassociated from the evolution of the radial expansion, for example by continuously and uniformly increasing along the whole length of the volute from its tongue 24 to its distal end E2.

Advantageously, the profile of the peripheral wall 22 of the casing 14 in an axial plane is curved to form a substantially oval or elliptical portion intended to remove the angles inside the compartment 20. The axial section of the peripheral wall 22 preferably has a profile generally of "C"-shape, as shown by the view in axial section of FIG. 4. The volute thus includes an upper inner circumferential edge 30 which is curved inwardly and downwardly and a lower inner circumferential edge 32 which is curved inwardly and upwardly.

In accordance with the embodiment shown, the upper circumferential edge 30 is extended radially inwardly to form the peripheral edge 34 delimiting the axial mouth 16. The upper circumferential edge 30 extends partially above the fan 12, at the blades 13. The lower circumferential edge 32 is extended radially inwardly to form the bottom wall 36 of the casing 22, facing the axial mouth 16.

Figure 1:
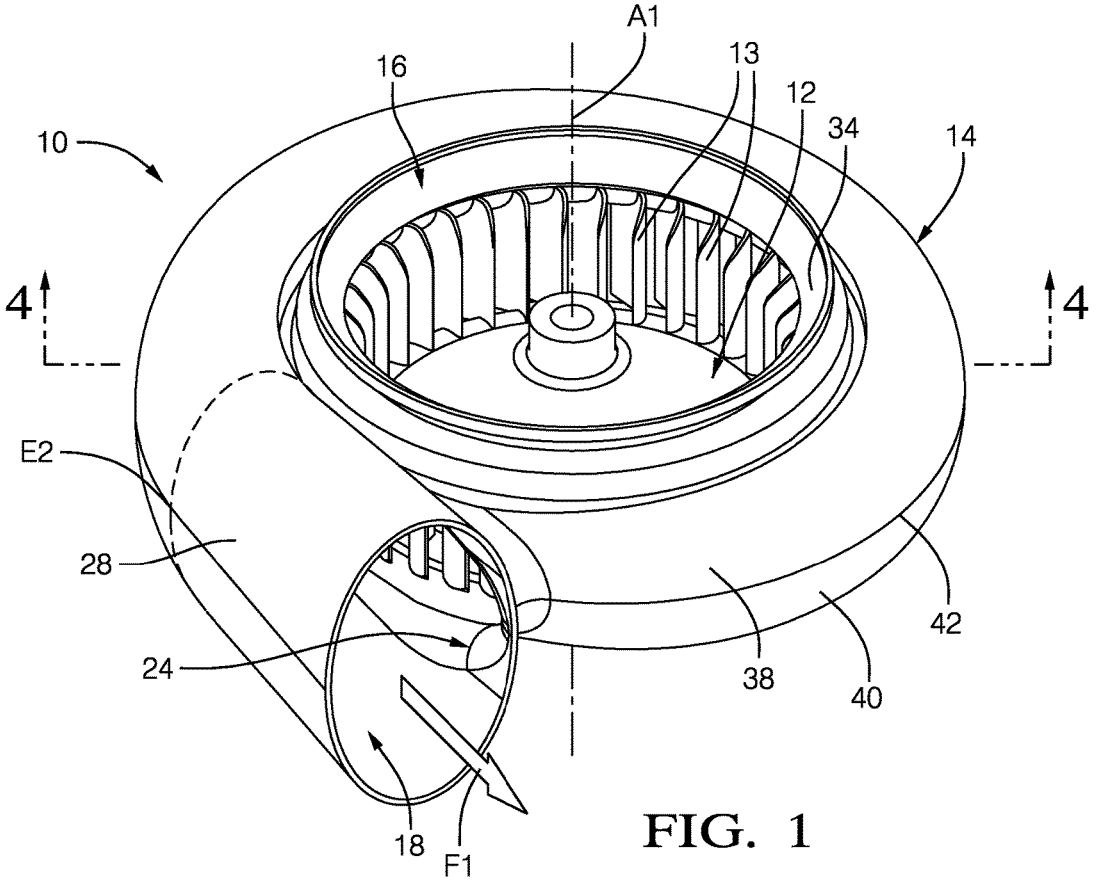
FIG. 1 is a perspective view which shows diagrammatically a ventilation device including a volute-shaped casing in accordance with the teachings of the invention.
Figure 2:
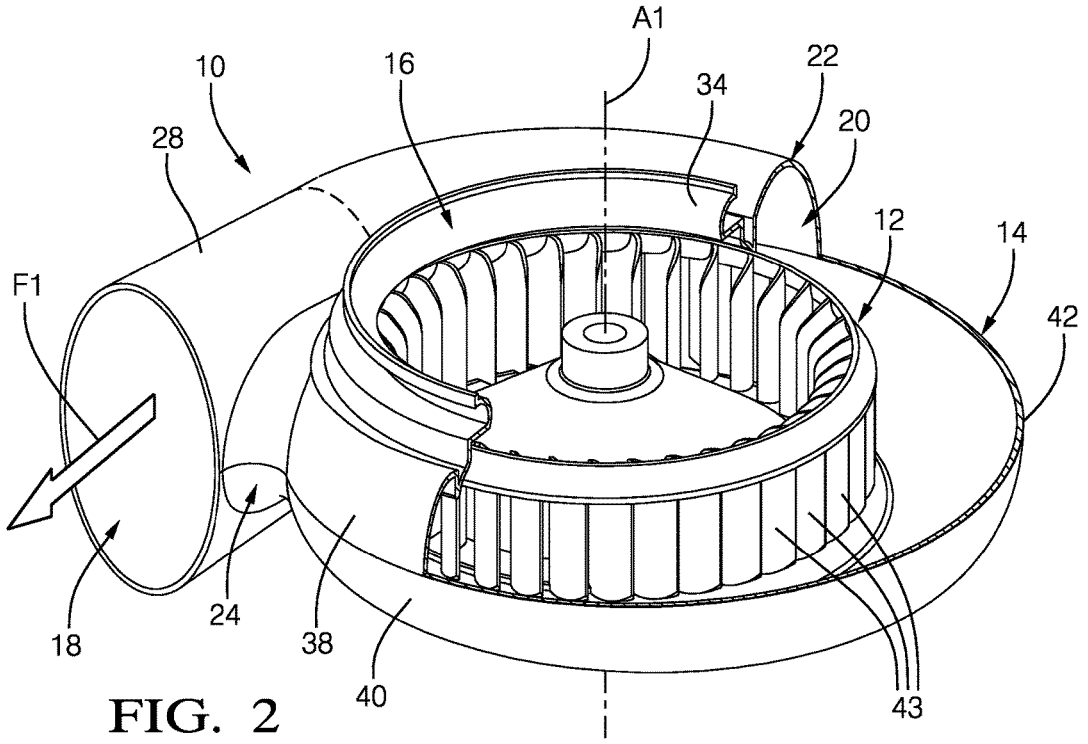
FIG. 2 is a view similar to that of FIG. 1 in which a portion of the casing has been removed to reveal the inside of the casing and the turbine.

Advantageously, the radial delivery mouth 18 has an axial section of rounded or ovalised profile as shown in FIGS. 1, 2 and 3, so that the outlet section progressively forms a tube.

Preferably, the volute tongue 24 has an ovalised generally elliptical or parabolic profile, which is shown in FIG. 3, so as to minimise the turbulence is produced in the forced air at the volute talent 24.

The casing 22 in accordance with the invention is particularly suited to a turbine 12 of which the outer profile, in an axial plane, is generally parallel with the axis A1, the outer section of the blades 13 being generally vertical.

Advantageously, the casing 14 is made in the form of two half-shells 38, 40 which are assembled one with the other in a joint plane 42 perpendicular to the axis A1 of the turbine 12, the joint plane 42 being shown in FIGS. 1 and 2. The two half-shells 38, 40 can thus be formed by moulding in plastics material.

Having described the invention herein, it is claimed:

1. A ventilation device for an apparatus for a heating, ventilation and/or air-conditioning of a motor vehicle passenger space, comprising a fan wheel having blades mounted turning about an axis of rotation (A1) inside a radially volute-shaped casing, the casing including an axial mouth for aspiration of air and a radial mouth for delivery of air which communicate with the inside of a volute-shaped compartment delimited by a peripheral wall of the casing, the peripheral wall of the casing moving progressively away from a periphery of the fan wheel from a volute tongue to a distal end ($E_2$) of the volute, the radial expansion of the volute being defined by an angle of expansion ($a_i$), wherein the initial angle of expansion ($a_1$) in a vicinity of the volute tongue is 1.5 times to 3 times greater than the final angle of expansion ($a_2$) in a vicinity of the distal end ($E_2$) of the volute, so that the peripheral wall of the casing moves more rapidly away from the blades at the start of the volute minimising turbulences generated at the volute tongue, and wherein the radial expansion of the volute is defined by the equation:

$$R_{vi} = (R_t + d_{tv}) \times e^{\left(\theta_i \times \tan\left(a_1 - \left(\frac{a_1 - a_2}{\theta_{max}}\right) \times \theta_i\right)\right)} \quad (1)$$

in which:

$R_{vi}$ is a radius of the volute at a determined point ($E_i$) of the volute, $R_t$ is the outer radius of the fan wheel, $d_{tv}$ is a minimum radial distance between an outer edge of the blades of the turbine and the volute tongue, $\theta_1$ is an angle defined by an initial end ($E_1$) of the volute and the determined point ($E_1$) of the volute about the axis of rotation (A1), $a_1$ is the initial angle of expansion of the volute, $a_2$ is the final angle of expansion of the volute, $\theta_{max}$ is the volute angle which corresponds to the angle defined by the initial end ($E_1$) of the volute and the distal end ($E_2$) of the volute about the axis of rotation (A1) and wherein the volute angle ($\theta_{max}$) is between 290 and 315 degrees.

2. The ventilation device of claim 1, wherein that the initial angle of expansion ($a_1$) is between 3.5 and 9 degrees.

3. The ventilation device of claim 1, wherein that the final angle of expansion ($a_2$) is between 3 and 5 degrees.

4. The ventilation device of claim 1, wherein that an axial section of the peripheral wall of the volute has a profile generally of "C"-shape.

5. The ventilation device of claim 4, wherein that the radial delivery mouth has an axial section of rounded or ovalised profile so that an outlet section, which extends from the distal end ($E_2$) of the volute to the radial delivery mouth progressively forms a tube.

6. The ventilation device of claim 5, wherein that an evolution of an axial expansion of the volute generally follows an evolution of the radial expansion of the volute.

7. The ventilation device of claim 6, wherein that the volute tongue generally has an ovalised profile.

8. The ventilation device of claim 7, wherein that an outer profile of the fan wheel, in an axial plane, is generally parallel with the axis (A1) of the fan wheel.

9. The ventilation device of claim 8, wherein that an inner circumferential edge of the volute is extended, on a side of the axial aspiration mouth, by a radial extension which covers a portion of the fan wheel and which delimits the axial aspiration mouth.

10. The ventilation device of claim 9, wherein that the casing is made in a form of two half-shells, the half-shells being assembled one with the other in a joint plane perpendicular to the axis (A1) of the fan wheel.

11. The ventilation device of claim 1, wherein that the initial angle of expansion ($a_1$) is between 3.5 and 9 degrees, and the final angle of expansion ($a_2$) is between 3 and 5 degrees.

* * * * *